US005767439A

United States Patent [19]

Lindblom et al.

[11] Patent Number: 5,767,439

[45] Date of Patent: Jun. 16, 1998

[54] ANNULAR PLASMA INJECTOR

[75] Inventors: John S. Lindblom, Crystal; Steven R. Zelenak, Champlin; Steven M. French, New Brighton; Mark E. Schneider, Vadnais Heights, all of Minn.

[73] Assignee: United Defense LP, Arlington, Va.

[21] Appl. No.: 473,156

[22] Filed: Jun. 7, 1995

Related U.S. Application Data

[62] Division of Ser. No. 155,675, Nov. 22, 1993, Pat. No. 5,503,081.

[51] Int. Cl.[6] ..... F42B 5/08

[52] U.S. Cl. ..... 102/472; 89/8; 102/202

[58] Field of Search ..... 89/8, 28.05; 102/202, 102/202.8, 202.9, 472, 443

[56] References Cited

U.S. PATENT DOCUMENTS

| | | | |
|---|---|---|---|
| 3,031,933 | 5/1962 | Kern et al. | 89/8 |
| 3,434,426 | 3/1969 | De Dapper | 102/202 |
| 3,815,507 | 6/1974 | Irish, Jr. et al. | 102/202.8 |
| 4,215,620 | 8/1980 | Tassie et al. | 102/472 |
| 4,913,029 | 4/1990 | Tidman et al. | 89/8 |
| 5,012,719 | 5/1991 | Goldstein et al. | 89/8 |
| 5,235,894 | 8/1993 | Nitschke et al. | 89/8 |
| 5,287,791 | 2/1994 | Chaboki et al. | 89/8 |
| 5,549,046 | 8/1996 | Widner et al. | 102/202.7 |

*Primary Examiner*—Charles T. Jordan
*Assistant Examiner*—Christopher K. Montgomery
*Attorney, Agent, or Firm*—Michael B. K. Lee; Douglas W. Rudy

[57] ABSTRACT

This disclosure relates to a plasma generation device particularly adapted to an electrothermal-chemical propulsion system. The device comprises a membranous conductive substance having structural compositions which enable the formation of a continuous and volumetrically distributed plasma arc. The membranous substance is versatile and operates, inter alia, as a fuse wire, plasma incubator, plasma container, plasma distributor, plasma infusion and permeation media as well as a fuel container.

7 Claims, 5 Drawing Sheets

ANNULAR PLASMA INJECTOR

This is a Division of application No. 08/155,675 filed Nov. 22. 1993. U.S. Pat. No. 5,503,081.

This invention was made with Government support under DAAA15-91-C-0124 awarded by the Department Of The Army. The Government has certain rights in this invention.

FIELD OF THE INVENTION

The present invention relates to annular and cylindrical plasma injector device which in cooperation with a membranous element provides stable discrete and continuous plasma arcs in a current path to enable equilibrated distributions, infusion and permeation of the plasma into a combustible mass.

SUMMARY OF THE INVENTION

The annular and cylindrical plasma injector device of the present invention enables the creation of an equilibrated non-shorting distribution, infusion and permeation of plasma throughout the extent of a combustible mass. Heretofore, plasma distributions into a combustible mass, particularly in applications where the plasma is generated across a fuse wire between an anode and cathode terminals, have experienced shorting of the plasma due to ionic plasma arc flowing via the ground return from the terminal. Consequently, the plasma arc is discharged into the combustible mass pre-maturely and is readily extinguished because of quenching and or uncontrolled combustion. The present invention overcomes these problems and provides a reliable and consistent plasma arc and distribution, infusion and permeation of same into a contiguous combustible mass.

More particularly, the membranous element enables the formation of annular and or cylindrical plasma which could be permeatively distributed and infused inwardly, outwardly or delivered into a desired location irrespective of the geometric shape, position and orientation of the combustible mass. Further, the membranous element proffers significant advances, inter alia, in that it acts as a fuel containment medium, a fuse wire and annular or cylindrical plasma arc source. Several embodiments of the membranous element may be used depending upon the contemplated application and desired results. The annular and cylindrical plasma injector device disclosed herein provides distinguished advances over prior practice. Included in these advances are enablement of reliable formation and delivery of plasma as well as enabling to strike a consistent arc across a slender capillary span thereby increasing plasma reach and surface area coverage within a containment cartridge. Further, because the need for an intermediate plasma distribution structure, such as a perforated tube, is eliminated significant weight and volume savings are realized over the prior art.

Specific advances, features and advantages of the present invention will become apparent upon examination of the following description and drawings dealing with several specific embodiments thereof.

DESCRIPTION OF THE PREFERRED EMBODIMENT

The annular and cylindrical plasma injector device of the present invention provides an efficient and directable distribution, infusion and permeation of high energy plasma into a combustible mass. Specifically, the present invention provides annular and or cylindrical plasma formation, incubation and permeative injection devices which can be integrated with a combustible mass container cartridge and a projectile, comprising a round. The embodiment of the present invention is supplied with each round of an electrothermal-chemical gun system and is generally spent with each firing. The present invention provides a significant advance in the art and is distinguished from earlier systems in that it enables the creation of annularly or cylindrically arranged continuous plasma arcs in cooperation with a membranous element which serves as a fuel storage, a fuse and a plasma distribution, infusion and permeative media. Accordingly, as will be discussed herein below, the annular or cylindrical geometry of the membranous element provides a large surface area for plasma discharge, distribution, infusion and permeation while eliminating plasma arc instabilities and shorting.

Figure 1:
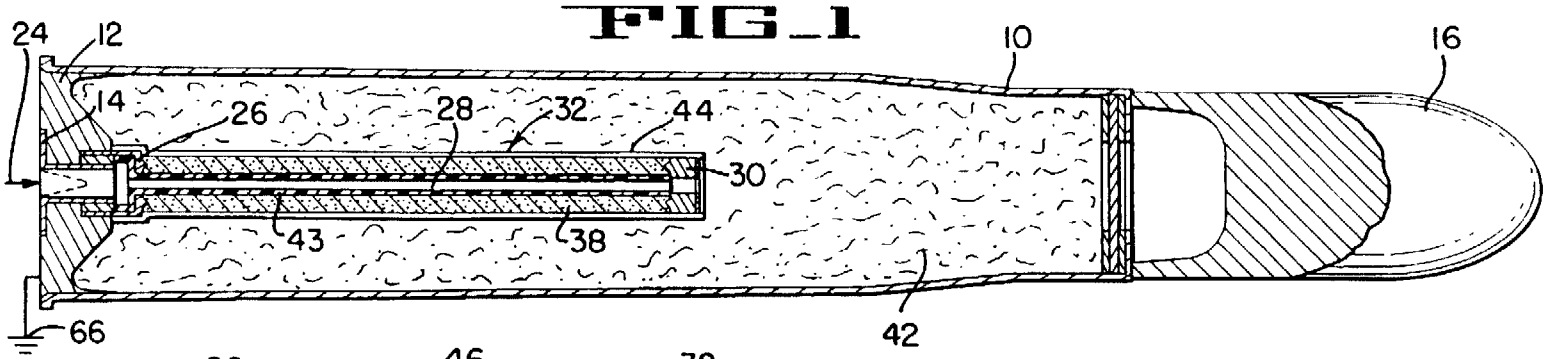
FIG. 1 is a central section of the annular plasma injector device incorporated in a cartridge.
Figure 1A:
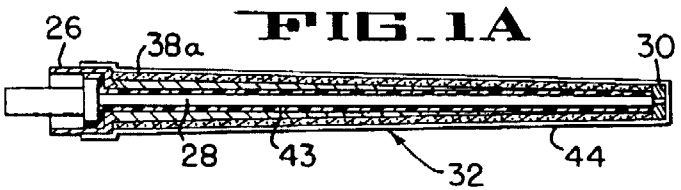
FIG. 1A is a central section of an alternate embodiment of a capillary shown without the cartridge.

An embodiment of the annular plasma injector device is shown in FIG. 1. Cartridge housing 10, comprising a stub case 12 and insulator 14 (polyethylene, polyurethane or equivalent), is integrally attached to projectile 16. Power supply connection 24 is disposed at the center of rim insulator 14 and is isolated by insulation means from power supply 24 and is connected to power rod 28 and anode 30. Annular capillary 32 forms an annular enclosure around cathode 26, power rod 28 and anode 30. Annular capillary 32 comprises membranous element 38 and internal dielectric liner 43. Annular capillary 32 is attached to cathode 26 at stub case 12 and cantilevers out into combustible mass 42 which is contained in cartridge housing 10. As indicated hereinabove, the central core of annular capillary 32 comprises power rod 28. Insulator sheath 43 separates annular capillary 32 and power rod 28. Cathode 26 is connected to anode 30 via membranous element 38. Further, annular capillary 32 is internally and externally covered with insulator sheath 43 and 44, respectively. FIG. 1A depicts capillary 32 having a tapered membranous element **38*a*, an example of an alternate structure. In the interest of simplicity cartridge housing 10** is not shown.

Figure 1B:
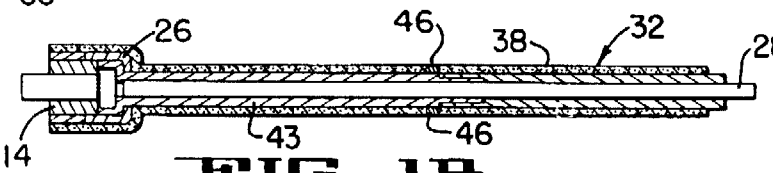
FIG. 1B is a central section showing membranous element and an intermediate electrode.

FIG. 1B is a detail section of annular capillary 32 where intermediate electrode 46 is shown. As will be discussed hereinbelow, one or more of this type electrodes can be used to effect segmentation of arcs and creation of serial arcs within a cartridge.

Figure 2A:
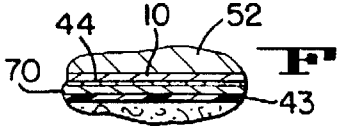
FIG. 2A is a detail section showing a foil membrane in lieu of membranous element.
Figure 2:
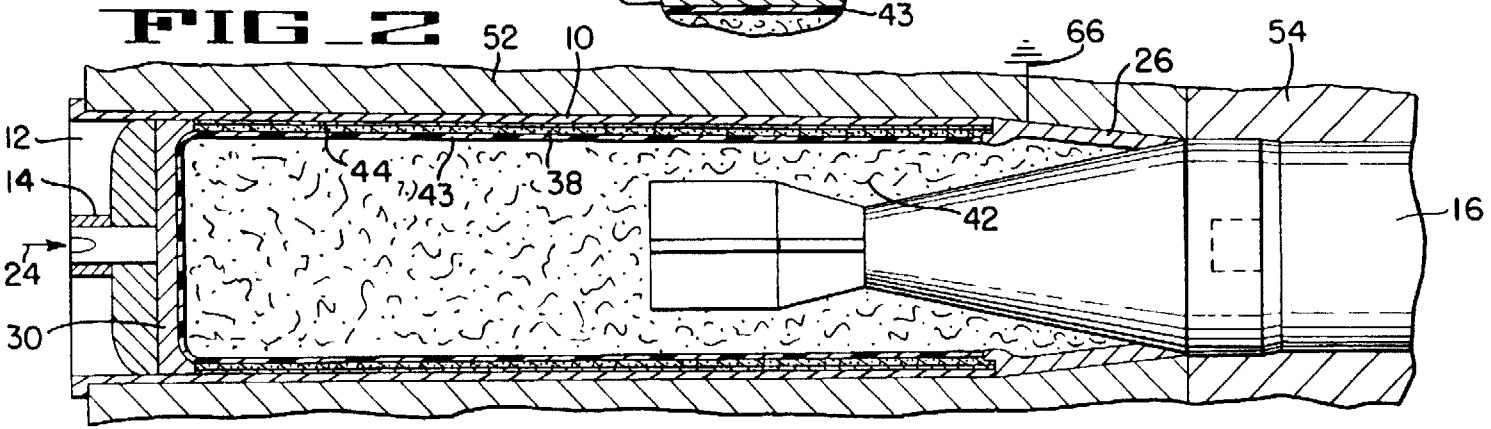
FIG. 2 is a central section showing membranous element forming outer annulus of combustible mass.

Turning now to FIG. 2, a detail segment of membranous element 38 is shown wherein a foam like structure, and in the alternate a foil, comprise the structure of element 38. Further, the assembly is shown disposed in a gun chamber 52 with projectile 16 situated in gun tube 54. Membranous element 38 or foil membrane 70 shown in FIG. 2A form an outer annulus situated between cartridge 10 and combustible mass 42. This is a typical embodiment in which membranous element 38 is structured to serve as a fuse wire as well as a container for combustible mass. Isolation sheaths 43 and 44 are used to separate membranous element 38 from combustible mass 42 and case of cartridge 10 respectively. FIG. 2A shows foil membrane 70 replacing element 38. Foil 70 may be preferred in some applications where combustible mass 42 needs to be contained in a non-porous media or the vaporization rate of the membrane needs to be slower. Further, the structure enables an increase in surface area of plasma/propellant interface while promoting a significant intrusion of projectile 16 into cartridge 10.

Figure 3:
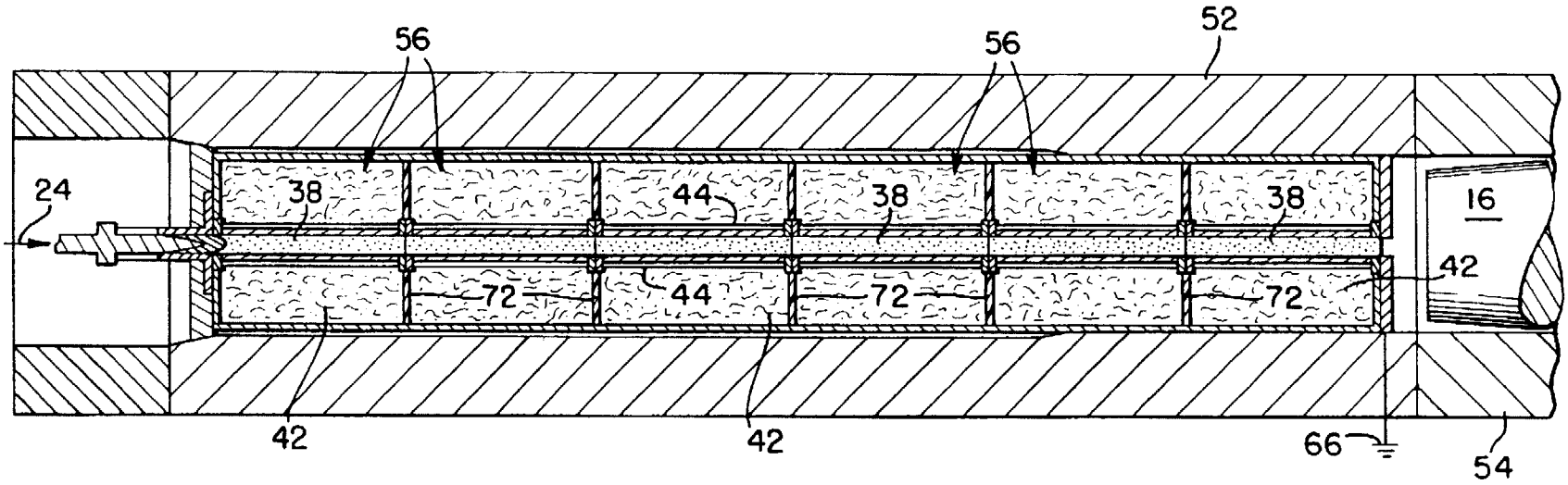
FIG. 3 is a central section of uni-charge modules structured to span large artillery chambers and allow for velocity zoning.

Considering now FIG. 3, another embodiment of the plasma injector is depicted with chamber 52 comprising a number of unicharge modules in chambers 56 which enable artillery velocity zoning. The assembly is shown in a gun chamber 52 with projectile 16 situated in gun tube 54. A power rod 28 extends to the base of the modules making contact with cylindrical membranous element 38 which is segmentally structured enabling a modular assembly capable of velocity zoning by varying charge mass and electric energy throughout the length or partial length of chamber 52. Each compartment section in charge modules 56 may contain varying composition, architecture and structure of charges and dividers 72 act as separators between the modules.

Figure 4A:
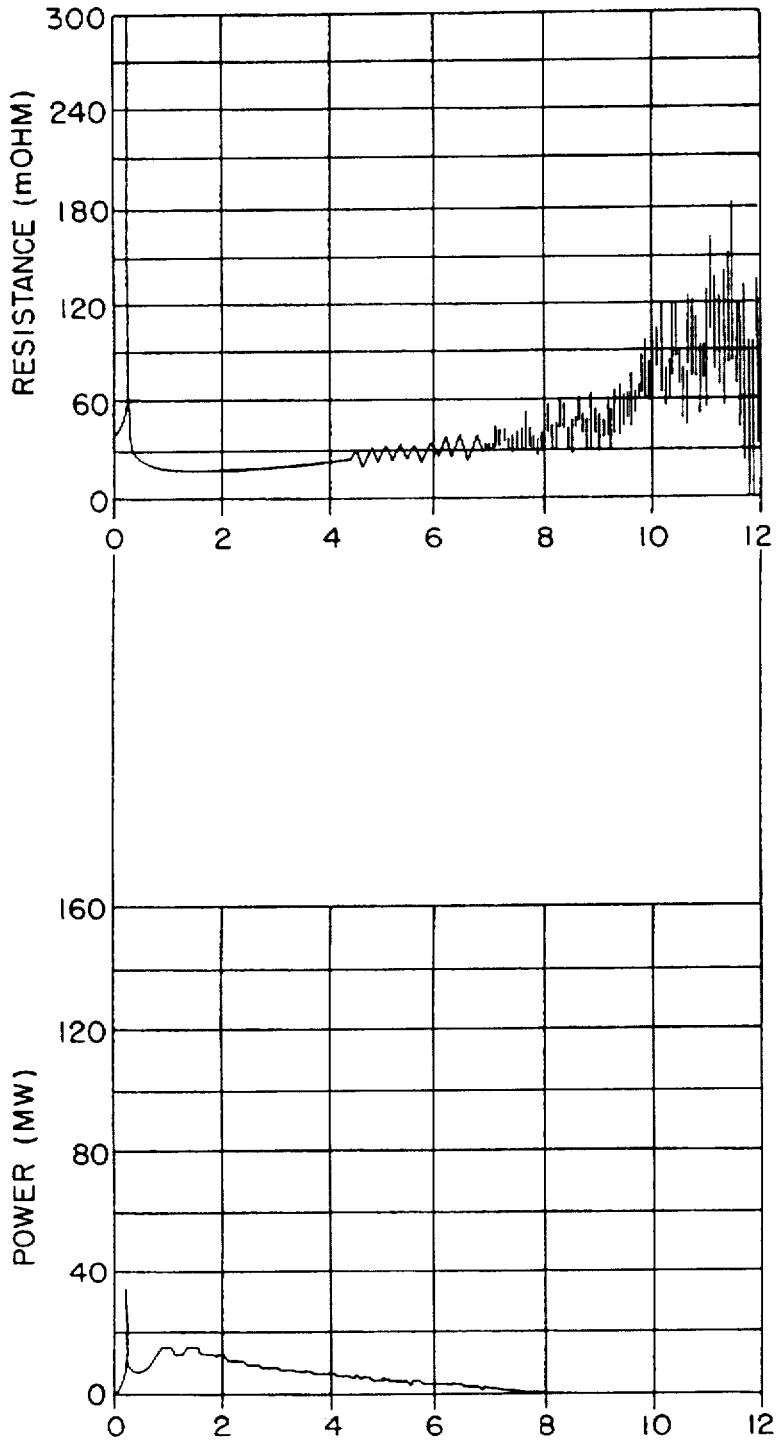
FIGS. 4A, 4B and 4C are graphical depictions of power in Mega Watts (MW) and resistance in milli-OHMS (mOHM) measured against time in milli-seconds (ms). The data is assembled using an, aluminum fuse wire, membranous aluminum cylindrical rod and membranous aluminum annular rod in an open air test arrangement, respectively.
Figure 4B:
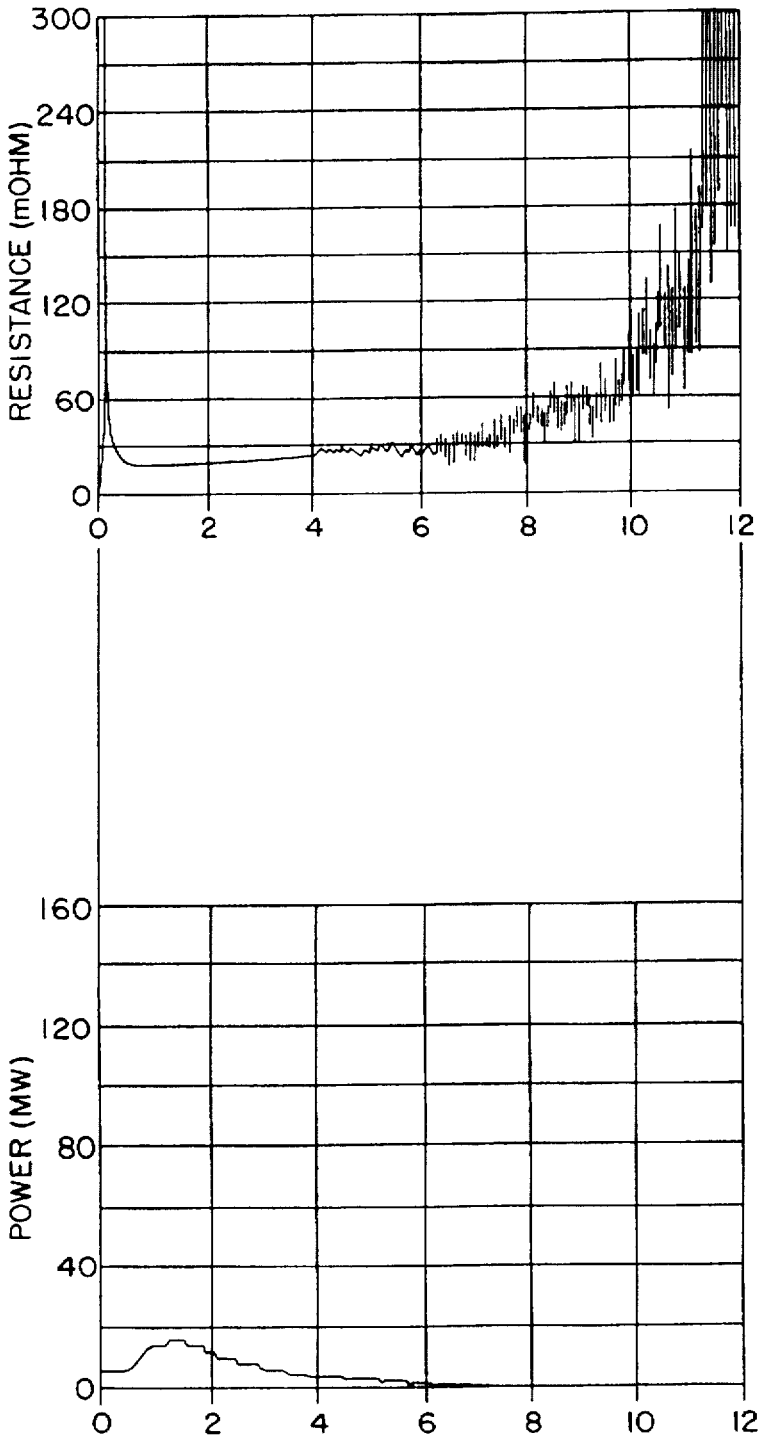
Figure 4C:
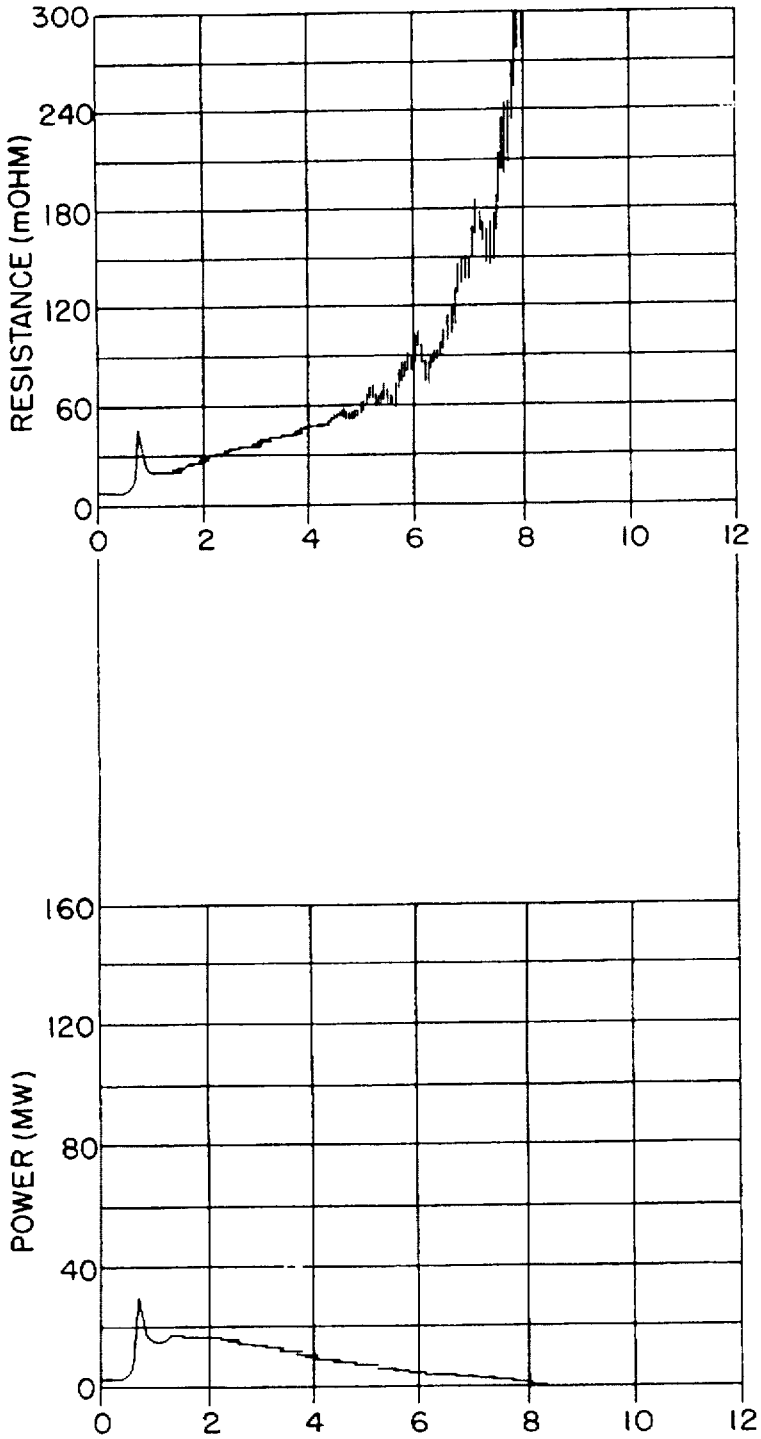

FIGS. 4A, 4B and 4C are graphical representations of operational and performance data obtained using an open air test fixture wherein, the performance of annular or cylindrical membranous elements 38 or 38*a* are tested and the results compared with that for a fuse wire. The open air test fixture (not shown) allows testing of plasma injection systems under atmospheric conditions to evaluate electrical stability and plasma distribution patterns. The sets of graphs are discussed hereinbelow to clearly identify some of the distinguishing performance and operational parameters of the present invention.

The disclosure hereinabove relates to some of the most prominent structural features of the present invention. The operation and the cooperative aspects of the structures, under a best mode scenario, is described herein below.

Referring to FIG. 1, sufficient power is supplied from a high energy pulse forming network or equivalent power supply source (not shown) and connected to the annular or cylindrical plasma injection device at power supply connection 24. Current flows to anode 30 via isolated power rod 28. From here the current flows to cathode 26 via membranous element 38. Accordingly, element 38 serves as an initial current path bridging cathode 26 and anode 30. One of the unique structural organizations of the present invention includes directing current to a remote anode 30 and returning the current to cathode 26 such that prior art limitations such as short circuiting which occur due to plasma flow past a conductive outer structure, for example a perforated tube, are eliminated. More particularly, by positioning anode 30 axially forward in combustible mass 42 with cathode 26 back near stub case 12, the requirement for a grounded cathode current return path is eliminated. Accordingly, this structure attenuates shorting through the cathode return and eliminates the problem of shorting which has hitherto made electrothermal-chemical cartridges susceptible to failure and malfunction. The current is grounded at ground 66 via stub case 12. When the current path is sufficiently established, membranous element 38 vaporizes allowing sufficient gas conductivity to establish a plasma between anode 30 and cathode 26, annularly about power rod 28. Insulator sheaths 43 and 44 are consumed thereby providing additional fuel for the plasma. Further, the consumption of sheath 44 allows plasma to interact with the surrounding combustible mass 42. Although a small portion of insulator sheath 43 may be eroded, generally, power rod 28 and its insulation (sheath 43) remain intact. Thus, annular plasma arc develops across the extent of annular capillary 32.

Particularly, membranous element 38 provides a significant advance in that it performs multi-functions. Primarily, element 38 acts as a fuse wire and is a current path as discussed hereinabove. In the preferred embodiment, membranous element 38 is made of a conductive element such as aluminum comprising spatially distributed random size pores interconnectively layered forming a foam-like woolly tubular structure. In some applications the size and orientation of the pores is decidedly uniform and symmetrical. This structure enables the formation of a transparent configuration with a loose open weave having an intertwined mesh construction with an inner and outer surface defining a layer. The ullage volume contained in the layer of element 38 enables a plasma expansion space. When element 38 vaporizes an annular plasma ring is formed extending through the length between anode 30 and cathode 26. Further, element 38 provides a containment region for plasma to be formed. Thus, the matted-type woolly labyrinthine foam structure having random or uniform size pores and orientation extending throughout the tubular layers of element 38, enables a continuous and volumetrically distributed formation of annular plasma. The resulting plasma is stable and yields a higher power profile than that of a typical solid fuse wire (see FIGS. 4A, 4B and 4C). Moreover, the random size/uniform size interconnected, internetted pores extending throughout the annularly homogenous foam layers of element 38 act as plasma distribution outlets through which plasma is discharged into the contiguous combustible mass 42. The ullage volume, inherent in element 38, may be used to store an energetic fluid to create a fuel-impregnated, more volatile plasma front for distribution. Accordingly, element 38 and the unique porous structure defining capillary 32 provides a gauze-like fibrous tube comprising layers with a predetermined volumetric capacity and performs as a fuse wire, annular plasma incubator, a plasma container, a plasma distributor, plasma infusion and permeation media as well as a fuel containment chamber.

In reference to FIG. 1, power supply connection 24 protrudes into stub case 12 forming an extended tip therein. Stub case 12 is isolated from power rod 28 which supports and connects with anode 30. As indicated hereinabove, element 38 connects anode 30 with Cathode 26. Cathode 26 is annularly disposed and coaxial with and isolated from power rod 28. Stub case 12 is isolated from power rod 28 and provides a ground contact with cathode 26. Further, dielectric liners 40 isolate power rod 28 from the internal surface of element 38. Similarly, insulator sheath 44 separates membranous element 38 from combustible mass 42. As stated hereinabove, in some applications, voids and cavities of labyrinthine membranous element 38 can be filled with a combustible fuel or fuel/ oxidizer combination. This arrangement utilizes the ullage volume of element 38 and provides an initial combustion chamber which promotes a rapid distribution and infusion of plasma-impregnated burning fuel into combustible mass 42.

FIG. 1A depicts an exemplary arrangement in which capillary 32 comprising membranous element 38*a* is tapered. The arrangement of FIG. 1A may be preferred in cartridges where the composition, architecture and density of combustible mass 42 (See FIG. 1) vary. More particularly, the tapered structure of membranous element 38*a* provides a varying spacial and temporal plasma discharge throughout the volumetric extent of annular capillary 32 thus enabling a plasma infusion and permeation rate which translates into controllable and efficient combustion. It should be noted that other shapes and configurations can be used depending upon the geometry and orientation of combustible mass 42 and the need to distribute plasma in a pre-determined direction and rate.

Similarly, FIG. 1B shows an exemplary variation of capillary 32. The distinguishing feature of this structure includes an intermediate anode 46. In very slender cartridges, where very long plasma discharge lengths are needed, this approach is preferred to create segmented serial annular arcs. Segmented serial annular arcs have proven to be more stable and provide manageable sets of discreet plasma arcs. In this particular application, the location of intermediate electrode 46 may be varied to provide plasma arc segments having varying length. Alternately, several intermediate electrodes 46 can be used to create a number of segmented plasma arc regions throughout combustible mass 42. This arrangement enables to maintain varying levels of plasma segments throughout the length of capillary 32. Particularly, membranous element 38 can be filled with fuel or oxidant having varying quantities and types of fuels in every segment as defined by intermediate electrodes 46. As noted hereinabove, each segment can be varied by varying the distance between intermediate electrodes 46. This feature enables to introduce a tailored amount of plasma into a combustible mass having variable volumes, chemical composition or architecture. Thus, intermediate electrode 46 and the associated structures of the present invention can be arranged to effect and accommodate variable plasma distribution and combustion rate requirements at different segments of a cartridge.

FIGS. 2 and 2A depict a specialized embodiment of the present invention showing the versatility of membranous element 38 and foil membrane 70. Primarily, membranous element 38 contains combustible mass 42 forming an outer annulus. In the alternate, foil membrane 70 is used as a container. In this arrangement, membranous element 38 or foil membrane 70 make up the innermost layer of cartridge 10 with a non-conductive layer between them. Thus, in addition to being a fuse wire, plasma container, plasma arc generator and fuel container membranous element can be used to house combustible mass 42. Power is supplied at power supply 24 which is connected to anode 30. Membranous element 38 or foil 70 is annularly connected to anode 30. On the farther end, cathode 26 is annularly connected to element 38 or foil 70. Evidently, the embodiment provides a compact and structurally efficient cartridge system. The structure provides simplicity in manufacturing while maintaining the advantages of multi-functionality proffered by membranous element 38. Further, this geometry allows for significant projectile intrusion into the cartridge case. Furthermore, the structure provides a maximum interaction surface area between combustible mass 42 and membranous element 38 or foil 70. When sufficient power is supplied, membranous element 38 or foil 70 heat up and vaporize to form annular plasma surrounding combustible mass 42. Consequently, plasma implosively infuses and permeates combustible mass 42 thereby promoting efficient combustion to produce the requisite pressure and temperature to accelerate projectile 16.

FIG. 3 shows another embodiment of the present invention. A series of uni-charge modules 56 of individual charge are shown within a slender artillery chamber wall 52. A segmented membranous element 38 extends across charge modules 56. Each module chamber 56 is a discreet package containing propellant mass and membranous element 38 isolated from the others by means of dielectric dividers 72. When the high energy current is supplied via power supply connection 24, membranous element 38 starts to heat up in each of charge modules 56. Eventually, membranous element 38 vaporizes allowing formation of a plasma which spans the filled length of the chamber 52. The plasma consumes sheath liner 44 and invades combustible mass 42 contained in each module chamber 56. Dividers 72 act as temporary separators preventing plasma from shorting to chamber wall 52, and are later consumed during the combustion cycle. The process enables a near instantaneous development of a balanced combustion pressure and temperature throughout chamber wall 52. Thus, modules can be assembled extending from one to complete chamber length thereby enabling velocity zoning.

FIGS. 4A, 4B, 4C are graphical data for the results of an open air test using an Aluminum fuse wire, membranous aluminum cylindrical rod and membranous aluminum annular rod, respectively. The test results of FIGS. 4A, 4B, 4C are obtained by applying high energy current via power supply connection 24. Primarily, the test is focused on measuring current and voltage thereby determining power and resistance. These parameters are determinative of performance for a plasma generation system. Typical open air test data for power in Mega Watts (MW) and Resistance in milli-Ohms (mOHM) against time in milli seconds (ms) are shown in FIGS. 4A, 4B, 4C. From these relations it can be observed that aluminum fuse wire (see FIG. 4A) experiences a power spike at about 0.4 milli seconds, the power reaches its highest peak and drops off rapidly after 2.0 milli seconds. Thereafter, the power decreases gradually and diminishes to zero at about 8 milli seconds. Generally, a power spike of this type imparts shock to the propellant and is undesirable. The resistance readings vary with time as well. Initially, after about 0.2 milli seconds a resistance spike develops showing that the initial flow of current through the fuse to be rather low. However, after about 0.3 milli seconds, the resistance starts to drop off quickly. Further, after about 8 milli seconds, the resistance increases rapidly and subsequently becomes erratic showing instability and deterioration of the arc which eventually leads to plasma arc extinguishment. In comparison, FIG. 4B shows resistance and power readings taken for membranous aluminum cylindrical rod. At about 0.05 milli seconds, the power reaches its highest peak and drops off rapidly until 0.2 milli seconds. Thereafter, the power increases gradually to about 0.8 milli seconds. The power then decreases gradually to zero at about 5.5 mill seconds. The resistance readings vary with time as well. Initially, at about 0.05 milli seconds the resistance increases rapidly. The resistance then falls off and exhibits a near constant reading from about 0.2 milli seconds to about 5 milli seconds. Similarly, readings for the power show a substantial rise in power at about 0.01 milli seconds followed by a drop at about 0.2 milli seconds. Thereafter, the power rises gradually to about 2.00 milli seconds to be followed by a gradual decent to zero at about 5.5 milli seconds. A comparison of the resistance and power curves of FIG. 4B with that of FIG. 4A confirms that the cylindrical membranous fuse provides significant advances and advantages over a standard fuse wire. First, the resistance spike in the fuse wire (see FIG. 4A) is comparatively high. This translates into high voltage and power spikes. Power spikes impart shock to the propellant and or combustible mass. Such shocks inhibit efficient combustion and therefore limit the development of constant pressure in the gun chamber. Consequently, the performance of the electrothermal-chemical gun system is severely curtailed. Second, as indicated hereinabove, a power spike develops in the case of the fuse wire (see FIG. A) and the curve shows a quick rise and fall thus yielding a small area under the curve. The power curve for the cylindrical membranous element exhibits a comparatively low spike and a curve profile having a gradual rise and fall, thus providing a large area under the curve.

Referring now to FIG. 4C, which shows resistance and power readings for membranous annular rod, the resistance readings show a subdued spike at 0.5 milli seconds. The readings fall immediately after 0.5 milli seconds and indicate a progressive increment thereafter showing a generally smooth increase in the resistance. This results in higher average power yield. As can be seen from the power graph, the power spike is much lower and the curve shows a smooth transition between the rise at 0.4 milli seconds and the gradual fall thereafter.

Accordingly, from these comparative graphs it can be shown that the membranous annular rod yields the highest power output for a given electrical energy input. Further, the membranous cylindrical rod yields the second highest power output with a typical fuse wire yielding the lowest power output. It should be noted that the open air test data was obtained for all three types of fuses under similar conditions. A general conclusion to be inferred from the open air test is that the membranous element, which is one of the significant aspects of the present invention, enables the annular plasma injection device to be electrically efficient and imparts less shock to the propellant or combustible mass. Further, because of a lower voltage spike than the fuse wire, the chances for dielectric breakdown are minimized thus eliminating short circuiting problems.

Thus, the annular plasma injector device disclosed herein enables formation and distribution of a confinable annular plasma arc chain to promote efficient burning of a combustible mass to thereby yield high muzzle velocity. Heretofore, plasma injection systems use exploding wires and electrodes to create a generally linear plasma arc source. Further, prior art distribution devices include perforated tube or equivalent devices which discharge plasma radially or in a vectored manner into a propellant or combustible mass chamber. The transfer of plasma for distribution from a fuse wire to a capillary by means of a perforated tube or an equivalent means resulted in the development of large resistance spikes as well as electrically unstable plasma thus posing insurmountable operability and reliability problems in the prior art practice. More importantly, a centrally located plasma generated from exploding fuse wires randomly attaches to the ground return through the distribution capillary, such as a grounded perforated tube, and creates a short which results in unpredictable ignition, poor power transfer and potentially uncontrollable detonation. The annular plasma injector disclosed herein enables a reliable formation, incubation and containment of plasma, as well as distribution, infusion and permeation of plasma into a combustible mass while overcoming all the limitations and problems encountered in the prior art. Particularly, the present invention provides a significant advance in the art by utilizing capillary 32 as a plasma source disposed, proximate to combustible mass 42. This eliminates the need for intermediate members, such as a perforated tube, to transfer and distribute plasma from a discharge source. As discussed hereinabove, plasma is directly infused and permeated into combustible mass 42 from membranous element 38. Moreover, unlike perforated tubes, annular capillary 32 consumably ablates with the added advantage of eliminating the likelihood of plasma attaching to the ground and short circuiting the electrothermal chemical combustion. Further, unlike fuse wires, the present invention provides a large surface area for plasma distribution and direct infusion of same into a contiguous combustible mass. More particularly, as discussed hereinabove with reference to FIGS. 2 and 2A, membranous element 38 or foil member 70 may be used to contain fuel to enhance plasma effects on combustible mass 42 or provide for fuel/oxidizer stratification. Additionally, by strategically placing intermediate electrodes 46 (See FIG. 1B), the present invention enables the creation of serially segmented plasma arcs to allow differentiated ignition and combustion patterns. In another embodiment, discrete charge modules incorporate a consumable plasma generating device. The charge modules are connected along a chamber length to allow for velocity zoning.

As indicated in the best mode embodiments disclosed hereinabove, annular plasma formation, incubation, segmentation, distribution, infusion and permeation is effectuated by the elements and cooperation thereof of this invention. Particularly, membranous element 38 with a labyrinthine, woolly, foam-like, gauzy and annularly layered capillary and or cylindrical formed rod provides a significant advance over the prior practice. Element 38 with its randomly and or uniformly oriented cavities and pores contains an ullage volume in which, as discussed hereinabove, fluid or fuel may be stored to impregnate the plasma with a preconditioning fluid, such as a HAN (HydroxylAmmoniumNitrite). In the alternate, a foil membrane may be used to provide the advantages noted hereinabove.

While a preferred embodiment of the annular plasma injection, device has been shown and described, it will be appreciated that various changes and modifications may be made therein without departing from the spirit of the invention as defined by the scope of the appended claims.

What is claimed is:

1. A plasma generating device comprising:

a membranous fuse having segments wherein said membranous fuse includes a matted type, woolly labrynthine foam structure having random size open pores and extending throughout an axial length of said membranous fuse;

a plurality of electrodes with at least one intermediate electrode between said segments and serially segmented plasma arcs being formed between said electrodes and said intermediate electrode; and means for supplying sufficient energy to vaporize said fuse and generate the plasma.

2. A plasma generator for an electrothermal gun cartridge comprising:

an elongated metallic rod member extending along a central core of the plasma generator;

an elongated annular insulator dielectric forming a sheath around and in engagement with and in coaxial relationship with the elongated metallic rod member;

an anode, a cathode and at least one intermediate electrode having connections to said elongated metallic rod with said intermediate electrode forming an interrupt therebetween; and an elongated annular metallic tube member extending around said elongated metallic rod member and having a gap at said interrupt such that an electrical voltage applied along the elongated metallic rod generates an electrical arc at said gap thereof to consume said annular metallic tube and generate the plasma.

3. The device according to claim 2 wherein said gap includes a fuse that burns when said voltage is applied to the elongated metallic rod.

4. The device according to claim 2 wherein said annular metallic tube includes a membranous capillary element having a matted type, woolly labrynthine foam structure having random size pores and orientation extending throughout an axial length of said annular metallic tube.

5. The device according to claim 4 wherein said membranous capillary element includes pores defining an ullage volume therein.

6. The device according to claim 5 wherein said membranous capillary includes internetted, interconnected, labrynthine open pores.

7. The device according to claim 4 wherein said membranous capillary element forms a structure for containing, incubating and distributing plasma within layers of said membranous capillary element defining a closed volume.

* * * * *